US009949551B1

(12) United States Patent
Boles et al.

(10) Patent No.: US 9,949,551 B1
(45) Date of Patent: Apr. 24, 2018

(54) WEARABLE CONTAINER ASSEMBLY FOR HOLDING A TOPICAL SUBSTANCE

(71) Applicants: Alaina Taylor Boles, Westerville, OH (US); Kimberly Ann Boles, Westerville, OH (US); Joseph Douglas Boles, Westerville, OH (US)

(72) Inventors: Alaina Taylor Boles, Westerville, OH (US); Kimberly Ann Boles, Westerville, OH (US); Joseph Douglas Boles, Westerville, OH (US)

( * ) Notice: Subject to any disclaimer, the term of this patent is extended or adjusted under 35 U.S.C. 154(b) by 130 days.

(21) Appl. No.: 14/969,086

(22) Filed: Dec. 15, 2015

Related U.S. Application Data

(60) Provisional application No. 62/092,559, filed on Dec. 16, 2014.

(51) Int. Cl.

| | |
|---|---|
| ***A44C 7/00*** | (2006.01) |
| ***A45D 40/22*** | (2006.01) |
| ***A45F 5/02*** | (2006.01) |
| ***A45F 5/00*** | (2006.01) |
| *A45D 40/00* | (2006.01) |

(52) U.S. Cl.
CPC ..... *A45D 40/22* (2013.01); *A45F 5/00* (2013.01); *A45F 5/02* (2013.01); *A45D 2040/0012* (2013.01); *A45F 2005/006* (2013.01)

(58) Field of Classification Search
CPC ..... A44C 7/00; A44C 13/00; A46B 5/02
USPC ..... 224/269
See application file for complete search history.

(56) References Cited

U.S. PATENT DOCUMENTS

| | | | | |
|---|---|---|---|---|
| 1,609,481 | A * | 12/1926 | McCarthy | A44C 5/003 131/241 |
| 2,356,722 | A * | 8/1944 | Harris | B43M 11/06 118/201 |
| 3,559,854 | A * | 2/1971 | Loveland | A44C 5/003 132/294 |
| 4,185,753 | A * | 1/1980 | Leto | A45D 7/04 206/233 |
| 4,502,298 | A * | 3/1985 | Benton | A24F 19/0064 224/219 |
| 4,536,889 | A * | 8/1985 | Taylor | A41D 27/12 2/160 |
| 4,785,642 | A | 11/1988 | Chin et al. | |
| 4,844,308 | A * | 7/1989 | Porteous | A61C 19/006 206/63.5 |

(Continued)

*Primary Examiner* — Brian D Nash
(74) *Attorney, Agent, or Firm* — The Law Office of Patrick F. O'Reilly III, LLC

(57) ABSTRACT

A wearable container assembly for holding a topical substance configured to be applied to a portion of a body of a user is disclosed herein. The wearable container assembly includes a base portion having a top surface and a bottom surface, the base portion including one or more decorative elements attached to the top surface thereof; a fastener member attached to the bottom surface of the base portion, the fastener member configured to removably attach the wearable container assembly to hair of a user, a limb of a user, or an article of clothing worn by the user; and a container subassembly for holding a topical substance that is configured to be applied to a portion of a body of the user, the container subassembly removably coupled to the base portion by attachment means. A wearable topical substance container assembly comprising a topical substance is also disclosed herein.

20 Claims, 21 Drawing Sheets

(56) References Cited

U.S. PATENT DOCUMENTS 5,169,315 A * 12/1992 Bull ..... A61C 19/006 206/63.5
6,189,542 B1 2/2001 Shepard
6,360,928 B1 * 3/2002 Russo ..... A45F 5/00 224/218
6,397,633 B1 * 6/2002 Wu ..... A44C 9/0069 63/1.11
6,439,388 B1 * 8/2002 Lerner ..... A47G 19/065 206/562
6,474,345 B2 11/2002 Rodriquez et al.
D502,311 S 3/2005 Ellis
D528,290 S 9/2006 Anderton
D563,096 S 3/2008 Ivey
7,942,293 B2 * 5/2011 Lawrence ..... A45C 11/008 224/197
8,016,801 B2 9/2011 Clarke
8,136,686 B2 3/2012 Schlatter
8,276,598 B1 10/2012 Shepard et al.
8,474,668 B2 * 7/2013 Toman ..... A45F 5/00 224/219
8,747,002 B2 6/2014 Izkovitz
8,891,947 B2 * 11/2014 Neumann ..... A01M 1/2077 392/386
9,516,930 B2 * 12/2016 Izkovitz ..... A44C 9/0069
2003/0111497 A1 * 6/2003 Lukaris ..... A45F 5/02 224/197
2006/0219742 A1 * 10/2006 Chen ..... A44C 5/003 224/148.4
2009/0095781 A1 * 4/2009 Ramsey ..... A45C 11/22 224/269
2012/0055965 A1 * 3/2012 Zhang ..... B65H 75/4434 224/269
2012/0060861 A1 3/2012 Van Cleef
2014/0130819 A1 5/2014 Karam

* cited by examiner

WEARABLE CONTAINER ASSEMBLY FOR HOLDING A TOPICAL SUBSTANCE

CROSS-REFERENCE TO RELATED APPLICATIONS

This patent application claims priority to, and incorporates by reference in its entirety, U.S. Provisional Patent Application No. 62/092,559, entitled "Wearable Container Assembly For Holding A Topical Substance", filed on Dec. 16, 2014.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to wearable container assemblies. More particularly, the invention relates to wearable container assemblies that are configured to hold topical substances that are applied to a portion of a body of user.

2. Background

An ordinary wearable accessory only has a single function. For example, a typical hair clip has the sole purpose of keeping hair out of the eyes of the wearer. However, a wearable accessory would be far more useful and beneficial to the user thereof if it was capable of performing multiple functions.

Therefore, what is needed is a wearable device that is capable of performing multiple functions, such as serving as both a hair clip and container for a topical substance. Moreover, a wearable device is needed that incorporates a removable container for a topical substance so that the topical substance can be easily dispensed by the user thereof without necessitating the removal of the wearable device from the body portion or the clothing of the user. Furthermore, there is a need for a wearable device that is capable of being securely attached to the user, or to an article of clothing worn by the user, so that the wearable device does not become inadvertently detached from the user or the user's clothing.

BRIEF SUMMARY OF EMBODIMENTS OF THE INVENTION

Accordingly, the present invention is directed to a wearable container assembly for holding a topical substance that substantially obviates one or more problems resulting from the limitations and deficiencies of the related art.

In accordance with one or more embodiments of the present invention, there is provided a wearable container assembly for holding a topical substance configured to be applied to a portion of a body of a user. The wearable container assembly includes a base portion having a top surface and a bottom surface, the base portion including one or more decorative elements attached to the top surface thereof; a fastener member attached to the bottom surface of the base portion, the fastener member configured to removably attach the wearable container assembly to hair of a user, a limb of a user, or an article of clothing worn by the user; and a container subassembly for holding a topical substance that is configured to be applied to a portion of a body of the user, the container subassembly removably coupled to the base portion by attachment means.

In a further embodiment of the present invention, the base portion is in the form of a generally planar member.

In yet a further embodiment, the base portion is generally circular in shape.

In still a further embodiment, the one or more decorative elements comprise one or more artificial flowers or organic flowers.

In yet a further embodiment, the fastener member comprises one of: (i) a hair clip, (ii) a safety pin, (iii) a hairband, (iv) a wristband, (v) a hair scrunchie, and (vi) a lanyard.

In still a further embodiment, the wearable container assembly further comprises an attachment strip that attaches the fastener member to the bottom surface of the base portion.

In yet a further embodiment, the container subassembly is in the form of a cylindrical container with a central cavity for holding the topical substance.

In still a further embodiment, the container subassembly comprises a container body portion with a detachable lid attached to the container body portion.

In yet a further embodiment, the detachable lid is removably attached to an upper rim portion of the container body portion by means of a friction-fit type engagement.

In still a further embodiment, the detachable lid is removably attached to an upper rim portion of the container body portion by means of a threaded engagement, the upper rim portion of the container body portion comprising a plurality of external threads disposed on an outer surface thereof, and the detachable lid comprising a plurality of internal threads that correspond to the plurality of external threads on the upper rim portion of the container body portion.

In yet a further embodiment, the detachable lid is removably attached to an upper rim portion of the container body portion by means of a snap-fit type engagement, the upper rim portion of the container body portion comprising a circumferential projection disposed on an outer surface thereof, and the detachable lid comprising an internal groove that corresponds to the circumferential projection on the upper rim portion of the container body portion.

In still a further embodiment, the wearable container assembly further comprises a hinge member that hingedly connects the detachable lid to the container body portion.

In yet a further embodiment, the wearable container assembly further comprises a body tab portion extending radially outward from the container body portion, and a lid tab portion extending radially outward from the detachable lid, the lid tab portion configured to be grasped by the user so as to facilitate the removal of the detachable lid from the container body portion by the user.

In still a further embodiment, the topical substance comprises one of: (i) lip balm that is configured to be applied to lips of the user, (ii) skin cream that is configured to be applied to skin of the user, and (iii) blush makeup that is configured to be applied to a face of the user.

In yet a further embodiment, the attachment means that removably couples the container subassembly to the base portion comprises one of: (i) a hook-and-loop fastener device; (ii) a friction-fit attachment device that includes a projection portion on one of the container subassembly and the base portion, and a recess on the other of the container subassembly and the base portion that is configured to matingly engage with the projection portion; and (iii) a magnetic attachment device that includes at least one magnet disposed on one of the container subassembly and the base portion, and a magnetic material disposed on the other of the container subassembly and the base portion that is magnetically engageable with the at least one magnet.

In accordance with one or more other embodiments of the present invention, there is provided a wearable topical substance container assembly configured to be worn by a user. The wearable topical substance container assembly includes a base portion having a top surface and a bottom surface, the base portion including one or more decorative elements attached to the top surface thereof; a fastener member attached to the bottom surface of the base portion, the fastener member configured to removably attach the wearable topical substance container assembly to hair of a user, a limb of a user, or an article of clothing worn by the user; a container subassembly having a cavity portion, the container subassembly removably coupled to the base portion by attachment means; and a topical substance disposed in the cavity portion of the container subassembly, the topical substance being configured to be applied to a portion of a body of the user.

In a further embodiment of the present invention, the base portion is in the form of a generally planar member.

In yet a further embodiment, the base portion is generally circular in shape.

In still a further embodiment, the one or more decorative elements comprise one or more artificial flowers or organic flowers.

In yet a further embodiment, the fastener member comprises one of: (i) a hair clip, (ii) a safety pin, (iii) a hairband, (iv) a wristband, (v) a hair scrunchie, and (vi) a lanyard.

In still a further embodiment, the wearable topical substance container assembly further comprises an attachment strip that attaches the fastener member to the bottom surface of the base portion.

In yet a further embodiment, the container subassembly is in the form of a cylindrical container, the cavity portion of the container subassembly being disposed centrally within the cylindrical container.

In still a further embodiment, the container subassembly comprises a container body portion with a detachable lid attached to the container body portion.

In yet a further embodiment, the detachable lid is removably attached to an upper rim portion of the container body portion by means of a friction-fit type engagement.

In still a further embodiment, the detachable lid is removably attached to an upper rim portion of the container body portion by means of a threaded engagement, the upper rim portion of the container body portion comprising a plurality of external threads disposed on an outer surface thereof, and the detachable lid comprising a plurality of internal threads that correspond to the plurality of external threads on the upper rim portion of the container body portion.

In yet a further embodiment, the detachable lid is removably attached to an upper rim portion of the container body portion by means of a snap-fit type engagement, the upper rim portion of the container body portion comprising a circumferential projection disposed on an outer surface thereof, and the detachable lid comprising an internal groove that corresponds to the circumferential projection on the upper rim portion of the container body portion.

In still a further embodiment, the wearable topical substance container assembly further comprises a hinge member that hingedly connects the detachable lid to the container body portion.

In yet a further embodiment, the wearable topical substance container assembly further comprises a body tab portion extending radially outward from the container body portion, and a lid tab portion extending radially outward from the detachable lid, the lid tab portion configured to be grasped by the user so as to facilitate the removal of the detachable lid from the container body portion by the user.

In still a further embodiment, the topical substance comprises one of: (i) lip balm that is configured to be applied to lips of the user, (ii) skin cream that is configured to be applied to skin of the user, and (iii) blush makeup that is configured to be applied to a face of the user.

In yet a further embodiment, the attachment means that removably couples the container subassembly to the base portion comprises one of: (i) a hook-and-loop fastener device; (ii) a friction-fit attachment device that includes a projection portion on one of the container subassembly and the base portion, and a recess on the other of the container subassembly and the base portion that is configured to matingly engage with the projection portion; and (iii) a magnetic attachment device that includes at least one magnet disposed on one of the container subassembly and the base portion, and a magnetic material disposed on the other of the container subassembly and the base portion that is magnetically engageable with the at least one magnet.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
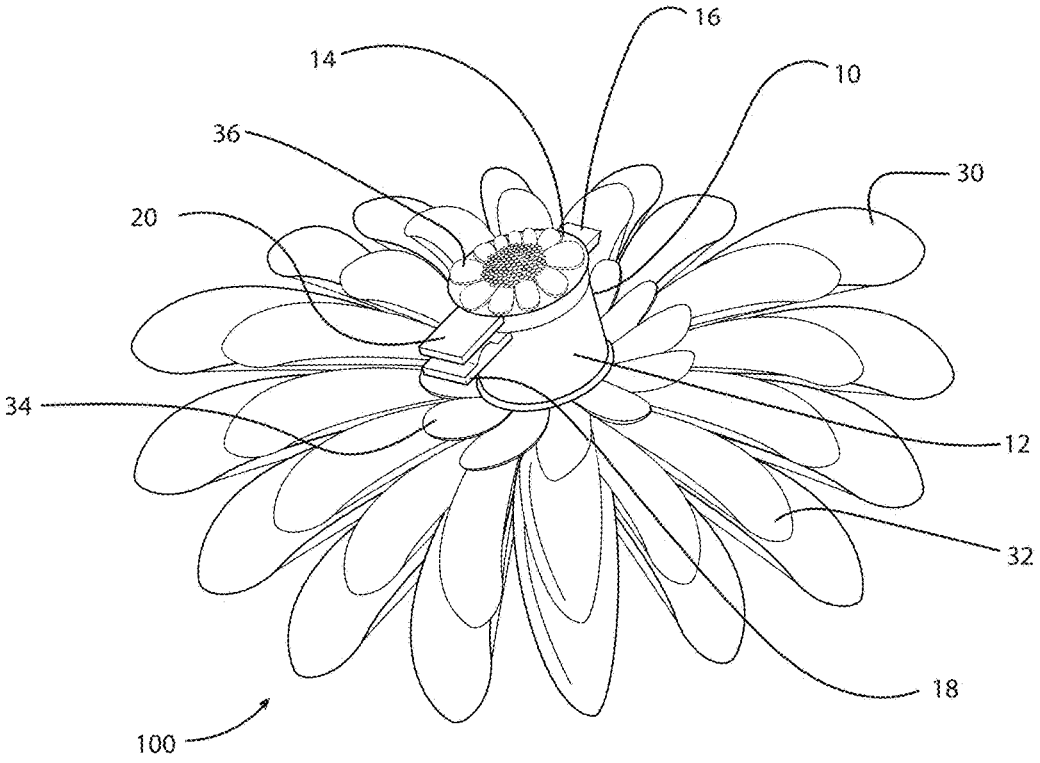
FIG. 1 is a top perspective view of a wearable container assembly for holding a topical substance, according to a first embodiment of the invention.
Figure 2:
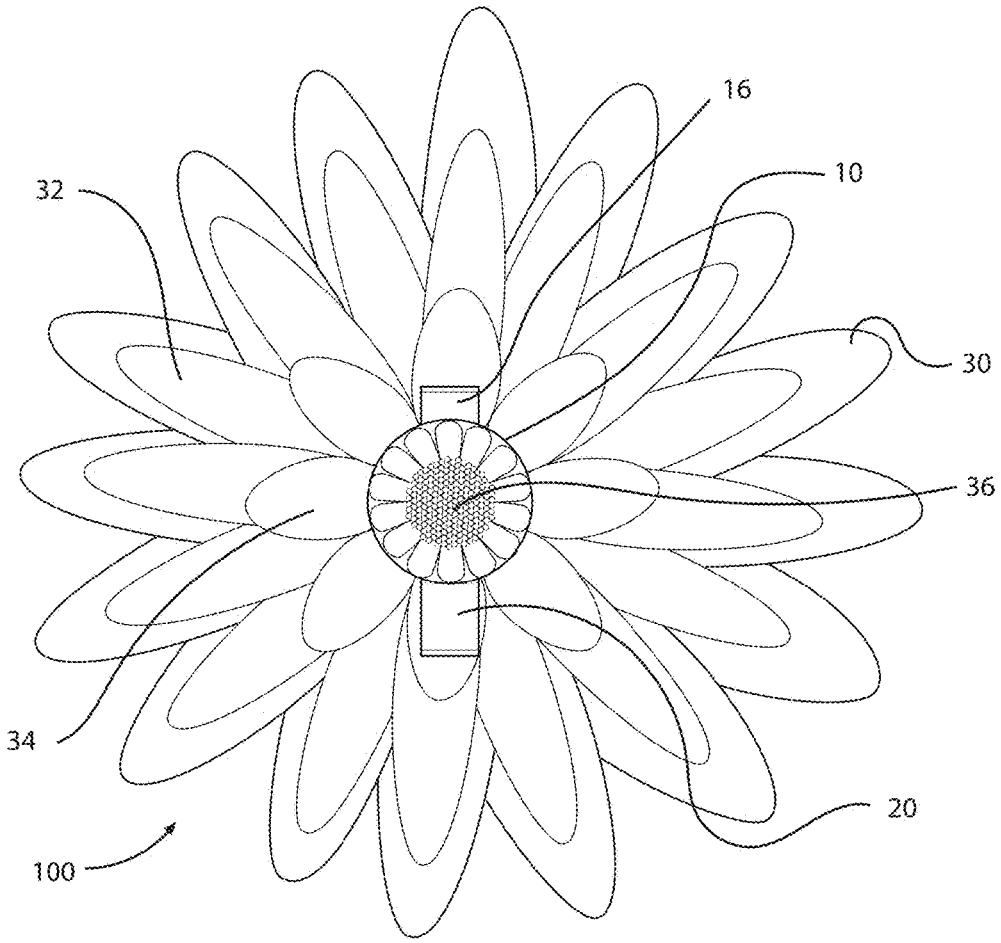
FIG. 2 is a top view of the wearable container assembly of FIG. 1.
Figure 3:
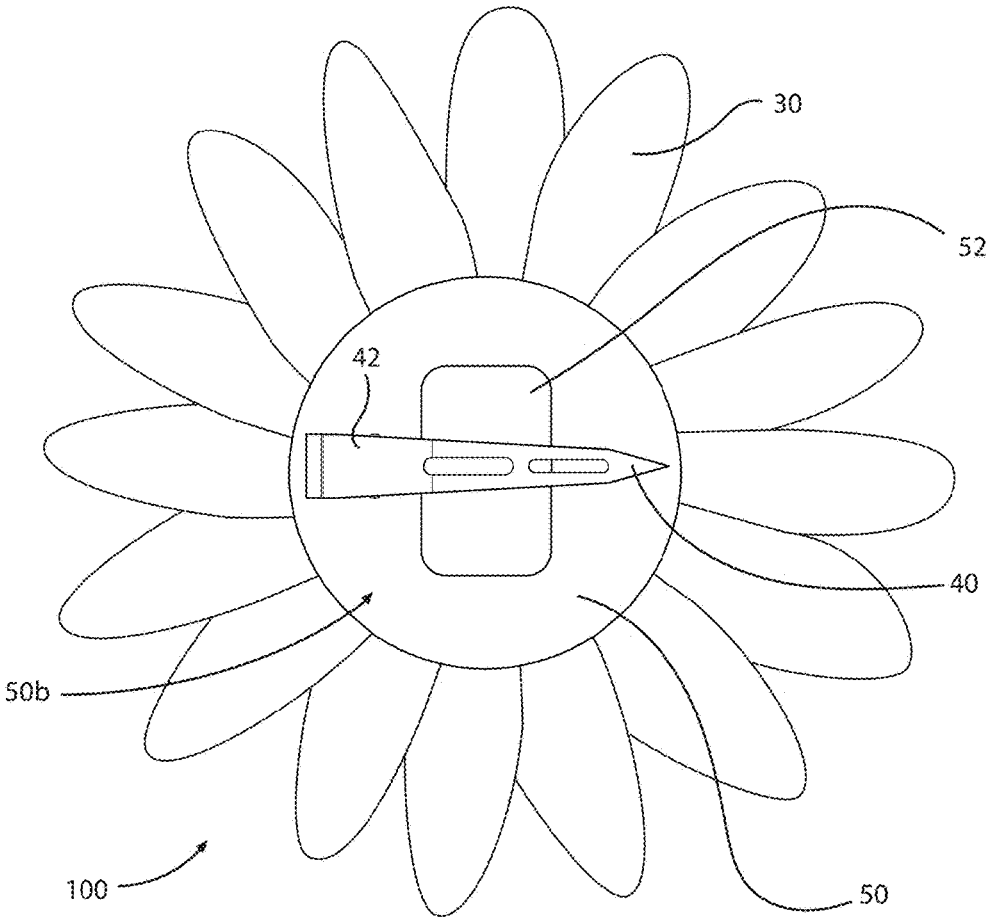
FIG. 3 is a bottom view of the wearable container assembly of FIG. 1.
Figure 4:
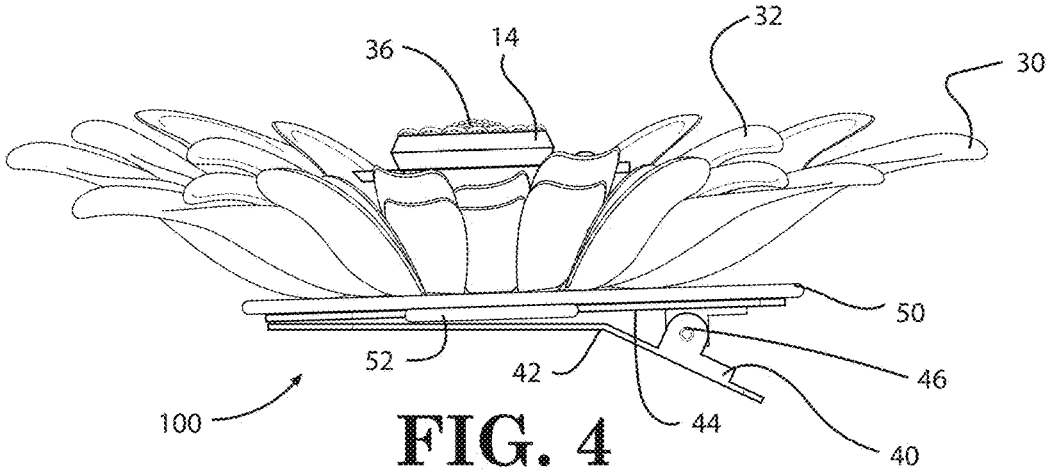
FIG. 4 is a first side view of the wearable container assembly of FIG. 1.
Figure 5:
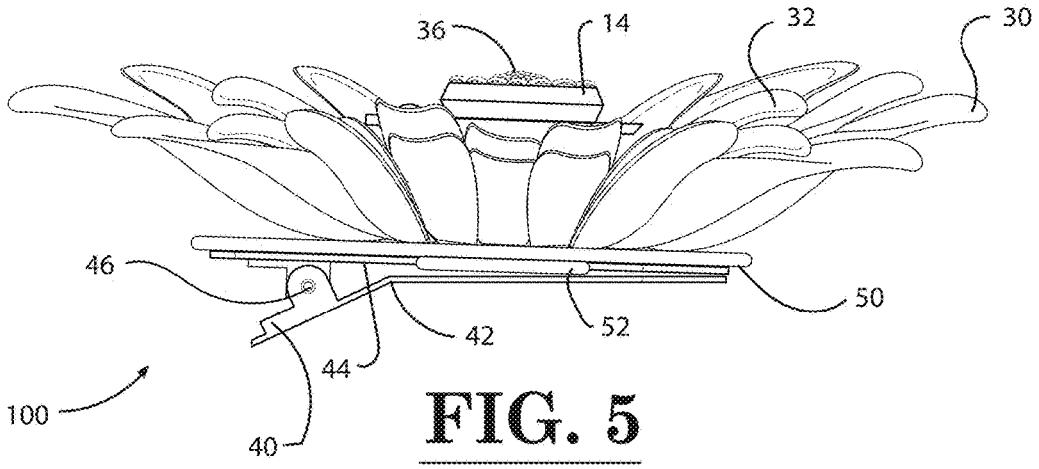
FIG. 5 is a second side view of the wearable container assembly of FIG. 1.

A first illustrative embodiment of a wearable container assembly for holding a topical substance configured to be applied to a portion of a body of a user is seen generally at 100 in FIGS. 1-8 and 15. As shown in these figures, the wearable container assembly 100 generally comprises a base portion 50 having a top surface 50*a* and a bottom surface 50*b*, the base portion 50 including a plurality of decorative elements (e.g., flowers 30, 32, 34 or ribbons) attached to the top surface thereof 50*a*; a fastener member (e.g., hair clip 40) attached to the bottom surface 50*b* of the base portion 50, the fastener member 40 configured to removably attach the wearable container assembly 100 to hair of a user, a limb of a user, or an article of clothing worn by the user; and a container subassembly 10 for holding a topical substance (e.g., lip balm 56) that is configured to be applied to a portion of a body of the user (e.g., the lips of the user), the container subassembly 10 removably coupled to the base portion 50 by attachment means (e.g., hook-and-loop fastener members 21, 54). In one or more embodiments, the topical substance disposed in the container assembly 10 may be in the form of lip balm 56 that is configured to be applied to lips of the user (see FIGS. 9-11), skin cream that is configured to be applied to skin of the user, sunscreen and/or sunblock configured to be applied to the skin of a user, or blush makeup that is configured to be applied to a face of the user. The container subassembly 10 is centrally located within each of the wearable container assemblies described and illustrated herein.

In the illustrative embodiment, with reference to FIGS. 3-6 and 8, it can be seen that the base portion 50 of the wearable container assembly 100 is in the form of a generally planar member, which is generally circular in shape. That is, the base portion 50 of the wearable container assembly 100 is in the form of a flat circular disk member. In an exemplary embodiment, the base portion 50 of the wearable container assembly 100 may be formed from a piece of felt or a polymeric material, such as plastic.

Figure 6:
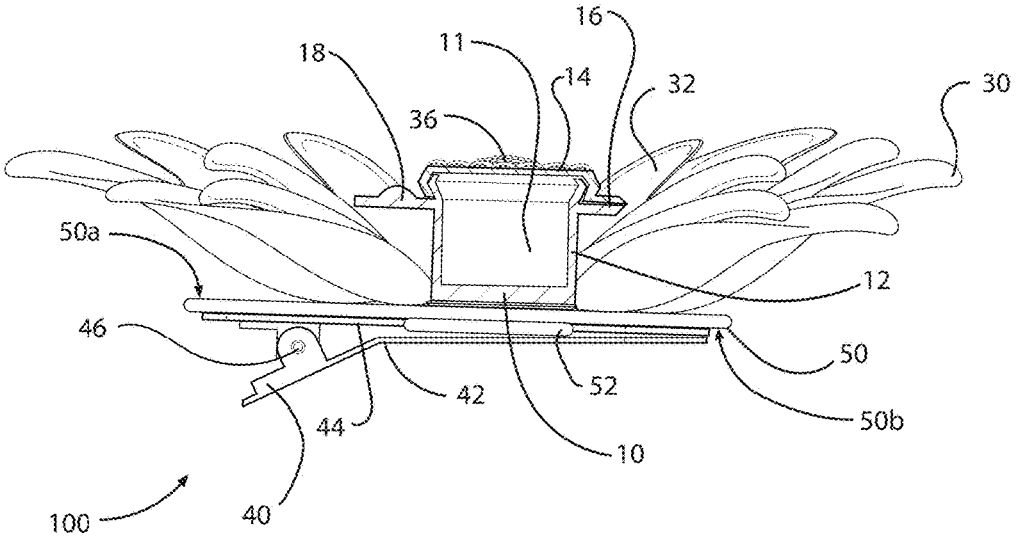
FIG. 6 is a cutaway side view of the wearable container assembly of FIG. 1, wherein an interior of a container subassembly is illustrated in a cutaway manner.
Figure 7:
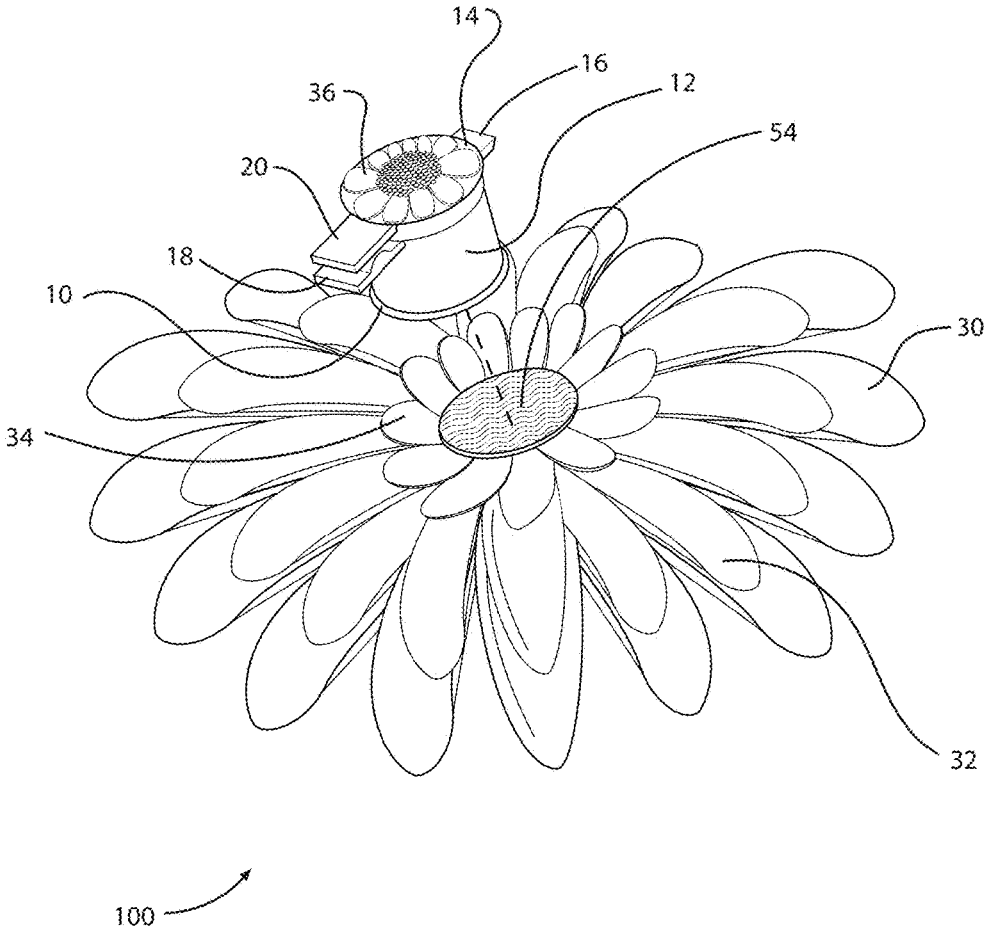
FIG. 7 is a partially exploded, top-side perspective view of the wearable container assembly of FIG. 1.

As best shown in the perspective views of FIGS. 1 and 7, a plurality of layered decorative elements 30, 32, 34 are mounted on the top surface 50*a* of the base portion 50. In the illustrated embodiment, the plurality of layered decorative elements 30, 32, 34 comprises a first decorative flower 30, a second decorative flower 32 layered on top of the first decorative flower 30, and a third decorative flower 34 layered on top of the second decorative flower 32. In the illustrated embodiment, each of the decorative flowers 30, 32, 34 comprises an artificial flower. Although, in an alternative embodiment, organic or real flowers may be used in lieu of artificial flowers, if desired. Also, as shown in FIGS. 1, 6, and 7, the top surface of the hinged lid 14 of the storage container 10 may also comprise a small, decorative flower 36 mounted thereon. Each of the decorative flowers 30, 32, 34 may be affixed to the base portion 50 and/or to one another using a suitable adhesive (e.g., a suitable glue).

Similarly, the decorative flower 36 may be affixed to the top surface of the hinged lid 14 of the storage container 10 using a suitable adhesive or glue.

Figure 8:
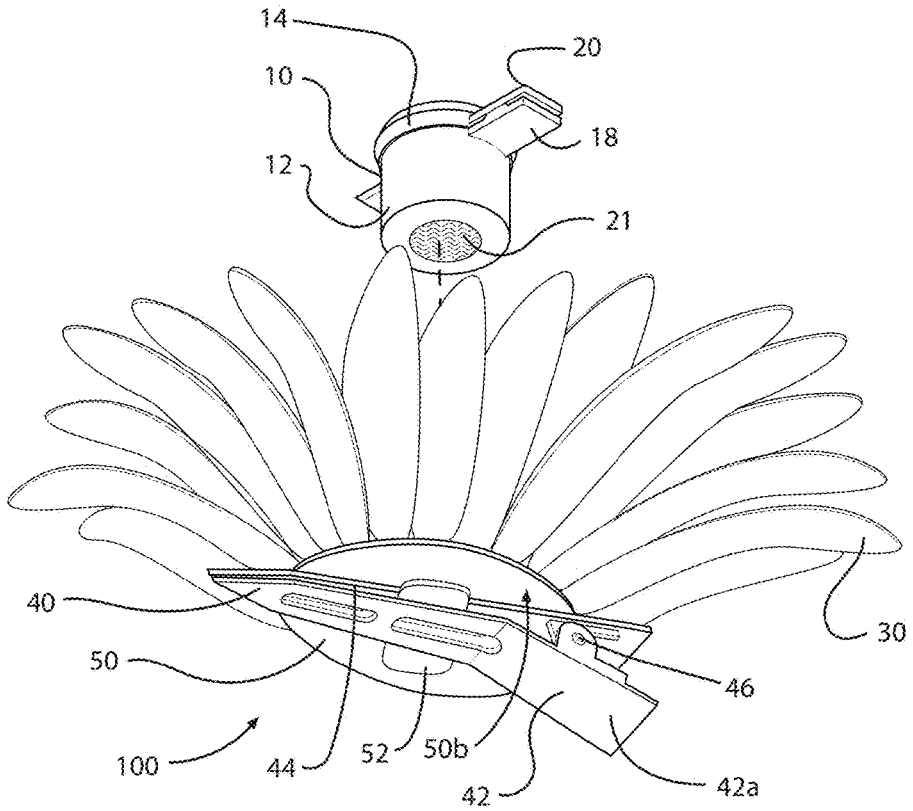
FIG. 8 is a partially exploded, bottom-side perspective view of the wearable container assembly of FIG. 1.

Next, referring to FIGS. 3-6 and 8, the fastener member 40 of the wearable container assembly 100 will be described. In the first illustrative embodiment, it can be seen that the fastener member 40 is in the form of a hair clip or barrette 40 for enabling the wearable container assembly 100 to be attached to the hair of a user. In particular, as shown in FIG. 8, the hair clip 40 of the wearable container assembly 100 comprises a first clip member 42, a second clip member 44, and a hinge portion 46 pivotably coupling the first clip member 42 to the second clip member 44. The second clip member 44 of the hair clip 40 is attached to the bottom surface 50*b* of the base portion 50 by a hair clip attachment strip 52. In an exemplary embodiment, the hair clip attachment strip 52 may comprise a flat strip of felt or plastic, and may be secured at its opposed ends to the bottom surface 50*b* of the base portion 50 using a suitable adhesive or glue. When a user wishes to attach the wearable container assembly 100 to her hair, the user applies a downward force to the diagonally-oriented end portion 42*a* of the first clip member 42 (beyond the pivot point of the hinge 46) so as to separate the respective pointed ends of the first and second clip members 42, 44 from one another. Then, the hair clip 40 is inserted into the user's hair, and is removably affixed in place in the user's hair when the user releases the force applied to the diagonally-oriented end portion 42*a* of the first clip member 42 (see FIG. 15). In the illustrative embodiment, the pivot pin of the hinge 46 of the hair clip 40 is provided with a spring element such that the first clip member 42 is biased towards its closed position, wherein the pointed ends of the first and second clip members 42, 44 are disposed together (i.e., the position illustrated in FIG. 8).

Figure 9:
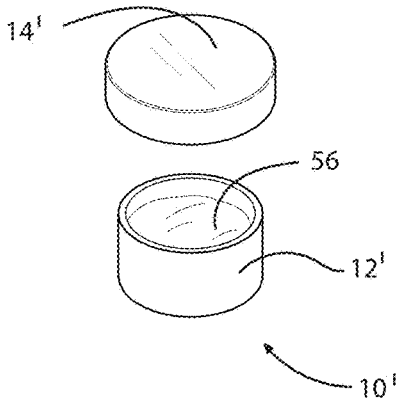
FIG. 9 is a perspective view of a first type of storage container used in conjunction with the embodiments of the wearable container assembly described herein, wherein a lid of the storage container is shown detached therefrom (i.e., the open position of container)
Figure 10:
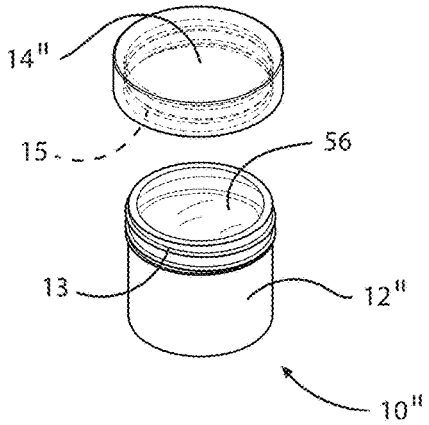
FIG. 10 is a perspective view of a second type of storage container used in conjunction with the embodiments of the wearable container assembly described herein, wherein a lid of the storage container is shown detached therefrom (i.e., the open position of container)
Figure 11:
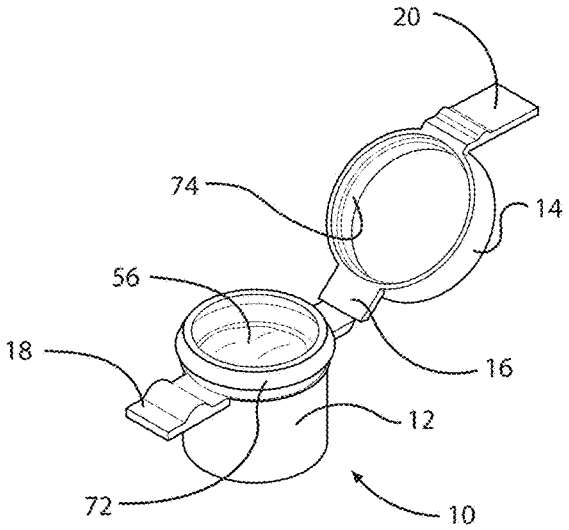
FIG. 11 is a perspective view of a third type of storage container used in conjunction with the embodiments of the wearable container assembly described herein, wherein a lid of the storage container is shown detached therefrom (i.e., the open position of container)

Now, referring primarily to FIGS. 1, 6, and 8-11, the container subassembly 10 of the wearable container assembly 100 will be described. Initially, referring to FIG. 6, it can be seen that the container subassembly 10 is in the form of a cylindrical container with a central cavity 11 for holding the topical substance (e.g., lip balm 56) therein. The container subassembly 10 comprises a container body portion 12 with a detachable lid 14 attached to the container body portion 12. The details of the container body portion 12 and lid 14 of the storage container utilized in the first illustrative embodiment of FIGS. 1-8 and 15 are best illustrated in FIG. 11. As shown in this figure, the detachable lid 14 of the container subassembly 10 is removably attached to an upper rim portion of the container body portion 12 by means of a snap-fit type engagement. In particular, the upper rim portion of the container body portion 12 comprises a circumferential projection 72 disposed on an outer surface thereof (see FIG. 11), while the detachable lid 14 comprises an internal groove 74 that corresponds to the circumferential projection 72 on the upper rim portion of the container body portion 12. When the lid 14 is closed by a user thereof, the circumferential projection 72 on the container body portion 12 snaps into engagement with the internal groove 74 on the detachable lid 14. A flexible hinge member 16 pivotally connects the detachable lid 14 to the container body portion 12 so that the lid 14 does not become lost from the container body portion 12 when the lid is in its open position. Referring again to FIG. 11, it can be seen that a body tab portion 18 extends radially outward from the container body portion 12, and a corresponding lid tab portion 20 extends radially outward from the detachable lid 14. The lid tab portion 20 is configured to be grasped by a user so as to facilitate the removal of the detachable lid 14 from the container body portion 12 by the user. That is, when it is desired to open the storage container 10, the user grasps the lid tab portion 20 and disengages the internal groove 74 on the detachable lid 14 from the circumferential projection 72 of the container body portion 12.

In an exemplary embodiment, the container body portion 12, the detachable lid 14, and the flexible hinge member 16 connecting the container body portion 12 to the detachable lid 14 may be formed from a suitable polymeric material (i.e., a suitable plastic). In the exemplary embodiment, the plastic material is sufficiently resilient so as to enable the flexible hinge member 16 to be elastically deformed each time the lid 14 is opened.

Alternative embodiments of the storage container 10', 10" will be described with reference to FIGS. 9 and 10. Initially, as shown in FIG. 9, a storage container 10' may be provided with an interference or friction fit-type lid 14'. That is, in FIG. 9, the detachable lid 14' is removably attached to an upper rim portion of the container body portion 12' by means of a friction-fit type engagement. The downturned rim of the detachable lid 14' frictionally engages the upper rim portion of the container body portion 12'. Turning to FIG. 10, it can be seen that a storage container 10" alternatively may be provided with a screw-on type lid 14". That is, in FIG. 10, the detachable lid 14" is removably attached to an upper rim portion of the container body portion 12" by means of a threaded engagement. The upper rim portion of the container body portion 12" comprises a plurality of external threads 13 disposed on an outer surface thereof, while the detachable lid 14" comprises a plurality of internal threads 15 that correspond to the plurality of external threads 13 on the upper rim portion of the container body portion 12". The plurality of internal threads 15 on the detachable lid 14" threadingly engage the plurality of external threads 13 on the upper rim portion of the container body portion 12" so as to securely retain the lid 14" in place on the container body portion 12".

Figure 12:
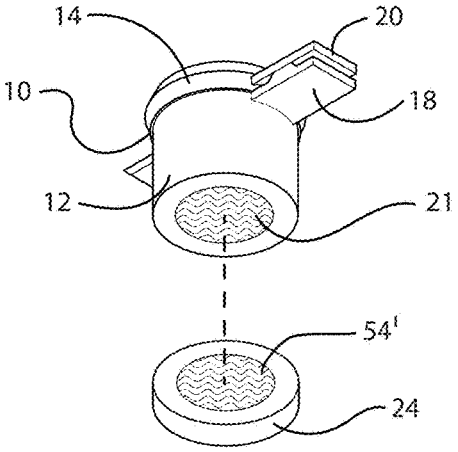
FIG. 12 is a partially exploded perspective view illustrating a first type of storage container attachment means used in conjunction with the embodiments of the wearable container assembly described herein.
Figure 13:
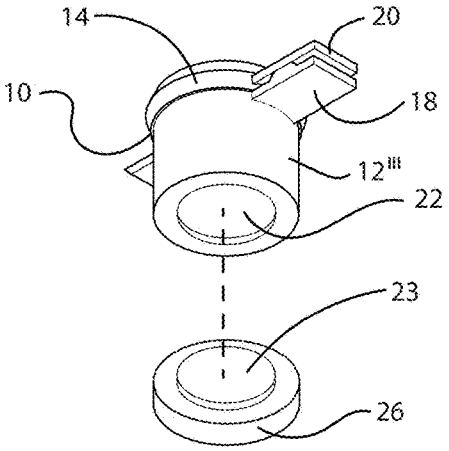
FIG. 13 is a partially exploded perspective view illustrating a second type of storage container attachment means used in conjunction with the embodiments of the wearable container assembly described herein.
Figure 14:
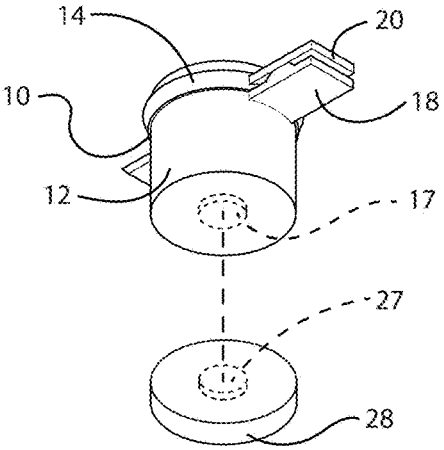
FIG. 14 is a partially exploded perspective view illustrating a third type of storage container attachment means used in conjunction with the embodiments of the wearable container assembly described herein.

Next, referring to FIGS. 12-14, illustrative embodiments of attachment means by which the container subassembly 10 may be removably attached to the base portion 50 of the wearable container assembly 100 will be explained. Initially, with reference to FIG. 12, the attachment means that removably couples the container subassembly 10 to the base portion 50 may comprise a hook-and-loop fastener device. In particular, as shown in FIG. 12, a first portion 54' of the hook-and-loop fastener device (i.e., a first piece of fabric with small hooks) may be mounted to a circular base member 24 (e.g., by using a suitable adhesive or glue). A second portion 21 of the hook-and-loop fastener device (i.e., a second piece of fabric with hair-like loops) may be mounted to the bottom surface of the container body portion 12 (e.g., by using a suitable adhesive or glue). When the first and second portions 21, 54' of the hook-and-loop fastener device are engaged with one another, the hooks of the first portion 54' catch in the loops of the second portion 21 so as to removably attach the container body portion 12 to the circular base member 24. When the first and second portions 21, 54' of the hook-and-loop fastener device are separated with one another, by a user grasping the container body portion 12 and pulling or peeling the two portions 21, 54' apart, the pieces of fabric are disengaged from one another, and make the characteristic "ripping" sound. The circular base member 24 with the first portion 54' of the hook-and-loop fastener device may be mounted to the top surface of the base portion 50 (e.g., by using a suitable adhesive or glue). Alternatively, as shown in FIG. 7, a first portion 54 of the hook-and-loop fastener device may be mounted directly to the base portion 50, or to one of the decorative flowers (e.g., flower 34) mounted to the base portion 50, without using the circular base member 24. However, the use of the circular base member 24 is desirable because it forms a secure base for the container subassembly 10 and adds increased rigidity to the base portion 50 of the wearable container assembly 100. In an exemplary embodiment, the circular base member 24 may be formed from a semi-rigid polymeric material or plastic in order to provide the increased structural rigidity for the wearable container assembly 100.

Another attachment means by which the container subassembly 10 may be removably coupled to the base portion 50 of the wearable container assembly 100 is illustrated in FIG. 13. In FIG. 13, a friction-fit attachment device is used for removably attaching the container subassembly 10 to the base portion 50 of the wearable container assembly 100. In particular, the friction-fit attachment device of FIG. 13 includes a circular base member 26 with a cylindrical projection 23 extending from the top surface thereof. The cylindrical projection 23 of the circular base member 26 is generally in the form of a disk-like boss extending from the top surface of the circular base member 26. As shown in FIG. 13, the bottom surface of the container body portion 12''' is provided with a cylindrical recess or bore 22 disposed therein that corresponds to the shape of the cylindrical projection 23 on the circular base member 26. When the container body portion 12''' is pressed against the circular base member 26, the cylindrical projection 23 matingly engages the cylindrical recess or bore 22 in an interference or friction-type engagement. A user disengages the container body portion 12''' from the circular base member 26 by grasping the container body portion 12''' and pulling it apart from the circular base member 26. The circular base member 26 with the cylindrical projection 23 may be mounted to the top surface of the base portion 50 or to one of the decorative elements (e.g., 34) by using a suitable adhesive or glue. Similar to that described above for the circular base member 24, the circular base member 26 advantageously forms a secure base for the container subassembly 10 and adds increased rigidity to the base portion 50 of the wearable container assembly 100. In an exemplary embodiment, the circular base member 26 may be formed from a semi-rigid polymeric material or plastic in order to provide the increased structural rigidity for the wearable container assembly 100.

In FIG. 14, yet another attachment means by which the container subassembly 10 may be removably coupled to the base portion 50 of the wearable container assembly 100 is shown. As depicted in FIG. 14, a magnetic attachment device is utilized for removably attaching the container subassembly 10 to the base portion 50 of the wearable container assembly 100. In particular, the magnetic attachment device of FIG. 14 includes a circular base member 28 with a first magnet member 27 (i.e. a first disk-shaped magnet) mounted on the top surface thereof (e.g., by using a suitable adhesive or glue). As shown in FIG. 14, the bottom surface of the container body portion 12 is provided with a second magnet member 17 (i.e. a second disk-shaped magnet) mounted thereon (e.g., by using a suitable adhesive or glue). The first and second magnet members 17, 27 may be oriented on the respective opposed surfaces of the container body portion 12 and the circular base member 28 such that different poles of the magnets are facing one another (e.g., the north and south poles) when the first and second magnet members 17, 27 are brought into engagement one another. As such, an attractive magnetic force between the first and second magnet members 17, 27 removably couples the container subassembly 10 to the base portion 50 of the wearable container assembly 100. In lieu of providing magnets on both the container subassembly 10 and the circular base member 28, it is to be understood that one of the container subassembly 10 and the circular base member 28 may be provided with a metallic material (i.e., a piece of metal), and the other of the container subassembly 10 and the circular base member 28 may be provided with a magnet that is attracted to the metallic material. When the container body portion 12 is brought into close proximity to the circular base member 28, the attractive magnetic force between the first and second magnet members 17, 27 removably engages the components 12, 28 in a secure manner. A user disengages the container body portion 12 from the circular base member 28 by grasping the container body portion 12 and pulling it apart from the circular base member 28, thereby breaking the magnetic bond between the first and second magnet members 17, 27. The circular base member 28 with the first magnet member 27 may be mounted to the top surface of the base portion 50 or to one of the decorative elements (e.g., 34) by using a suitable adhesive or glue. Similar to that described above for the circular base members 24, 26, the circular base member 28 advantageously forms a secure base for the container subassembly 10 and adds increased rigidity to the base portion 50 of the wearable container assembly 100. In an exemplary embodiment, the circular base member 28 may be formed from a semi-rigid polymeric material or plastic in order to provide the increased structural rigidity for the wearable container assembly 100.

Figure 15:
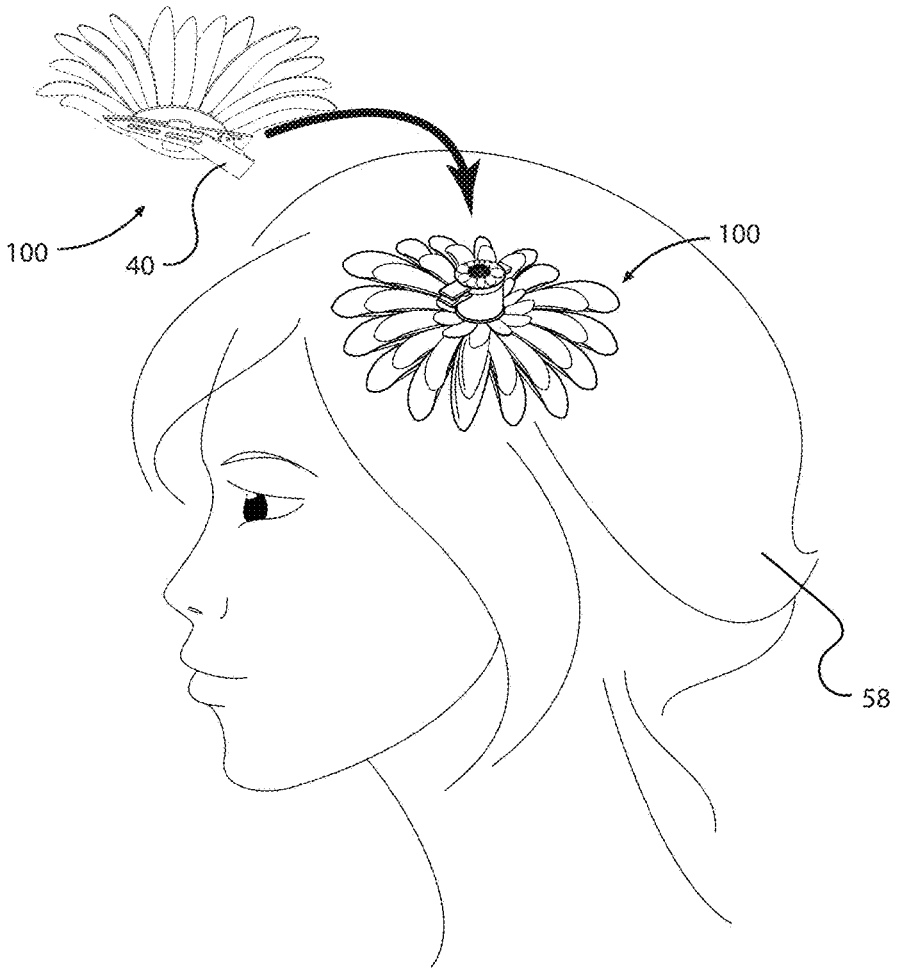
FIG. 15 is a perspective view illustrating the manner in which the first embodiment of the wearable container assembly may be attached to the hair of a user.

Referring to FIG. 15, the manner in which the first illustrative embodiment of the wearable container assembly 100 may be attached to hair of a user 58 is shown. In particular, as depicted in FIG. 15, the hair clip 40 is used to attach the wearable container assembly 100 to the hair of a user 58 so that the wearable container assembly 100 is capable of functioning as both a hair accessory and storage means for a topical substance (e.g., lip balm) that is to be applied to a portion of the body of the user 58.

Figure 16:
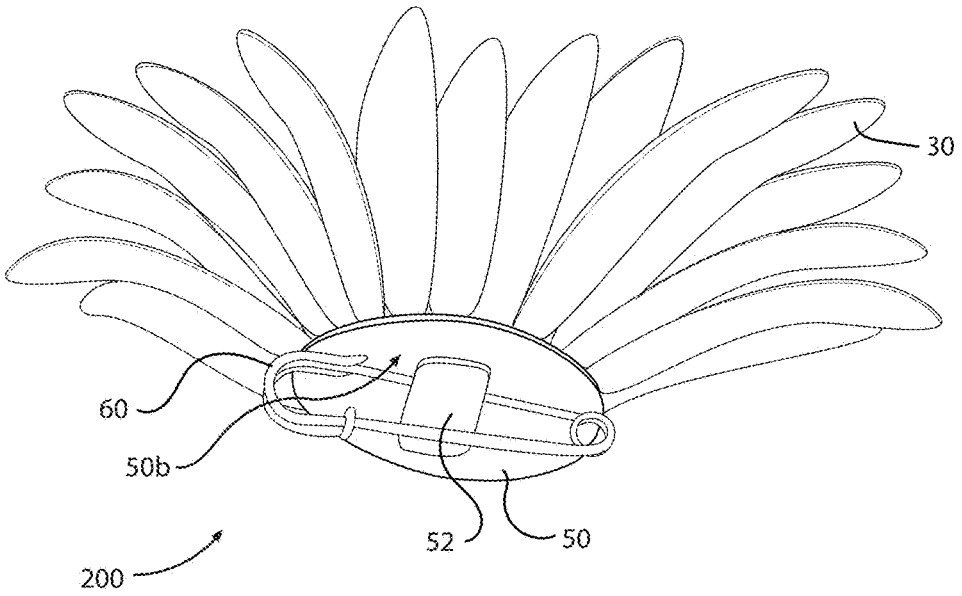
FIG. 16 is a bottom perspective view of a wearable container assembly for holding a topical substance, according to a second embodiment of the invention, wherein an alternative type of fastener member is provided on the bottom of an assembly base portion.
Figure 17:
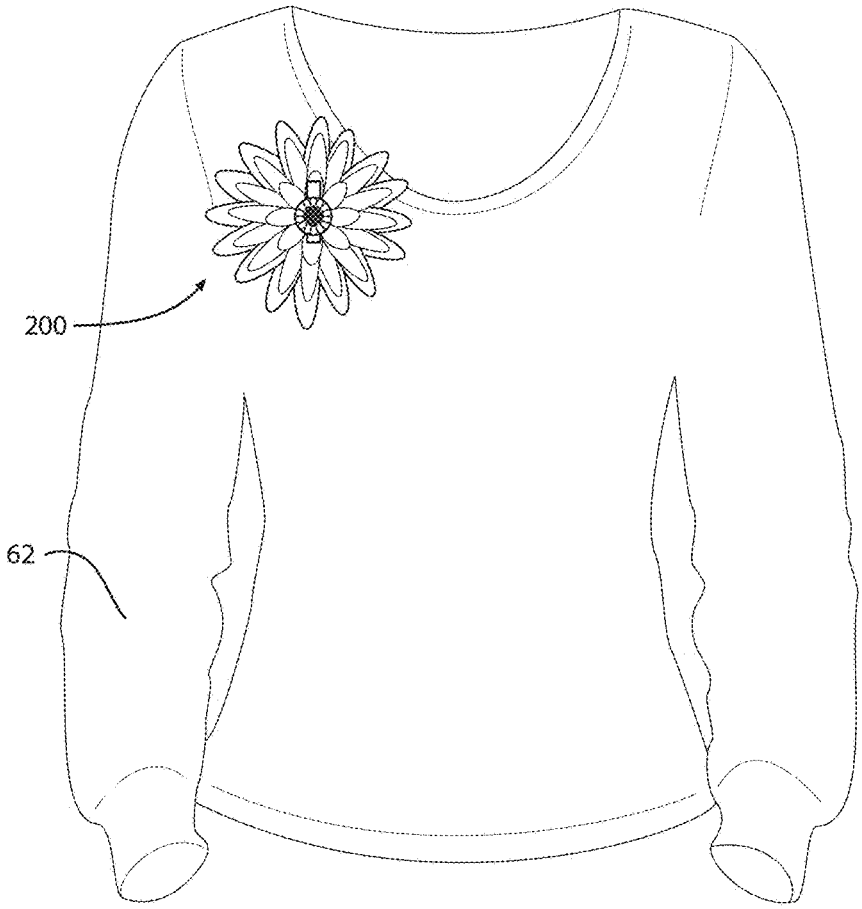
FIG. 17 is a perspective view illustrating the manner in which the second embodiment of the wearable container assembly may be attached to an article of clothing of a user.

A second illustrative embodiment of the wearable container assembly is seen generally at 200 in FIGS. 16-17. Referring to these figures, it can be seen that, in most respects, the second illustrative embodiment is similar to that of the first embodiment. Moreover, many elements are common to both such embodiments. For the sake of brevity, the elements that the second illustrative embodiment of the wearable container assembly has in common with the first embodiment will not be discussed because these components have already been explained in detail above. Furthermore, in the interest of clarity, these elements are denoted using the same reference characters that were used in the first embodiment.

In the second illustrative embodiment, as best shown in FIG. 16, the fastener member that is attached to the bottom surface **50*b* of the base portion 50 of the wearable container assembly 200 is the form of a safety pin 60, rather than the hair clip 40 of the first embodiment. Similar to that described above for the hair clip 40, the safety pin 60 is attached to the bottom surface 50*b* of the base portion 50 by an attachment strip 52. As described above, in an exemplary embodiment, the attachment strip 52 may comprise a flat strip of felt or plastic, and may be secured at its opposed ends to the bottom surface 50*b* of the base portion 50 using a suitable adhesive or glue. Advantageously, the safety pin 60 of the second embodiment is particularly useful when a user wants to attach the wearable container assembly 200 to an article of clothing, rather than her hair. For example, as illustrated in FIG. 17, the safety pin 60 may be used to securely attach the wearable container assembly 200 to an article of clothing 62, such as the shirt or sweater of FIG. 17**.

Figure 18:
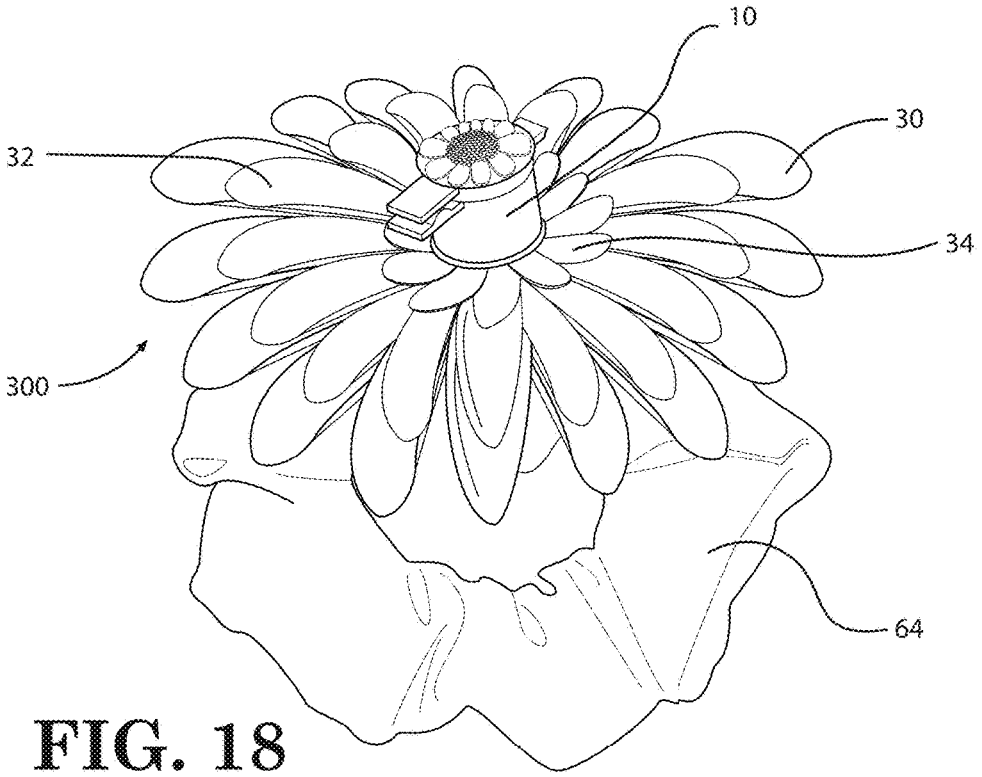
FIG. 18 is a top perspective view of a wearable container assembly for holding a topical substance, according to a third embodiment of the invention, wherein the wearable container assembly includes a fastener member in the form of a hair scrunchie.
Figure 19:
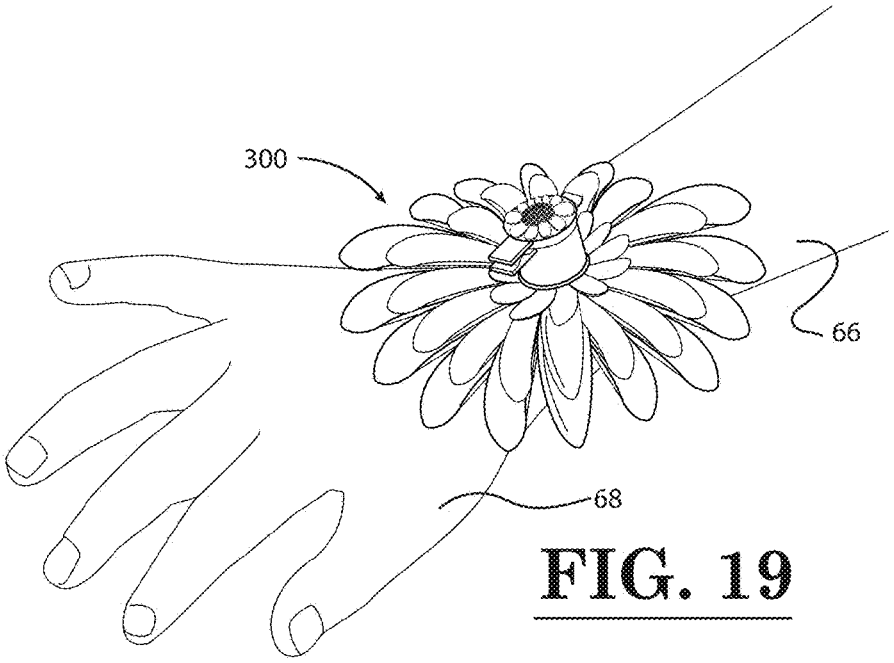
FIG. 19 is a perspective view illustrating the manner in which the third embodiment of the wearable container assembly may be worn on a limb of a user.

A third illustrative embodiment of the wearable container assembly is seen generally at 300 in FIGS. 18-19. Referring to these figures, it can be seen that, in most respects, the third illustrative embodiment is similar to that of the first and second embodiments. Moreover, many elements are common to all of the embodiments. For the sake of brevity, the elements that the third illustrative embodiment of the wearable container assembly has in common with the first and second embodiments will not be discussed because these components have already been explained in detail above. Furthermore, in the interest of clarity, these elements are denoted using the same reference characters that were used in the preceding embodiments.

In the third illustrative embodiment, as best shown in FIG. 18, the fastener member that is attached to the bottom surface 50*b* of the base portion 50 of the wearable container assembly 300 is the form of a hair scrunchie 64, rather than the hair clip 40 of the first embodiment and the safety pin 60 of the second embodiment. The hair scrunchie 64 is provided with an elastic band disposed therein so that the hair scrunchie 64 is capable of being securely attached to the hair of a user or to the body portion of the user in a removable manner. For example, as illustrated in FIG. 19, the hair scrunchie 64 may be used as a wristband to securely attach the wearable container assembly 300 to an arm 66 (i.e., a wrist) of a user by slipping the elasticized hair scrunchie 64 over the hand 68 of the user, and sliding it into place.

Figure 20:
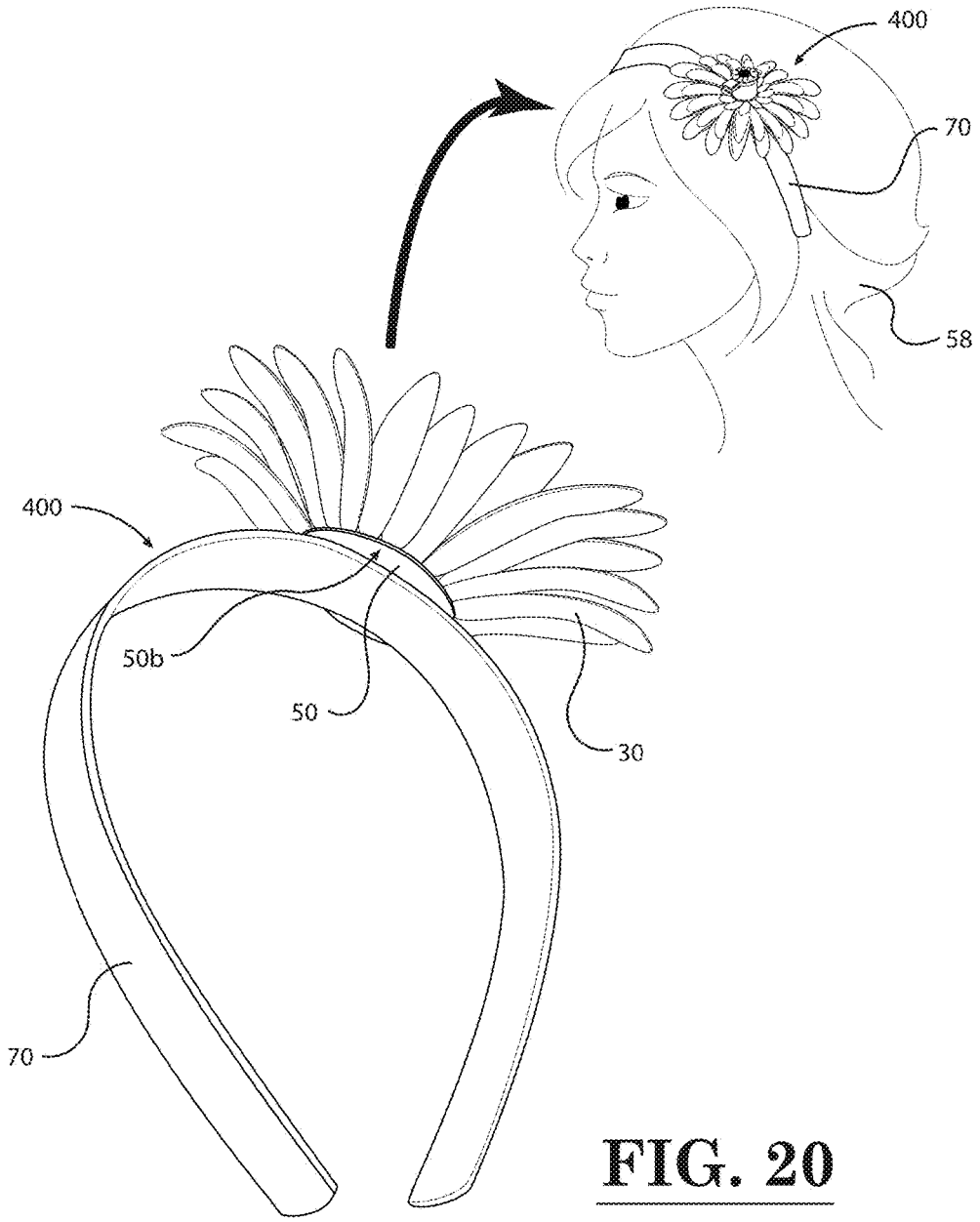
FIG. 20 illustrates perspective views of a wearable container assembly for holding a topical substance, according to a fourth embodiment of the invention, wherein the wearable container assembly includes a fastener member in the form of a headband.

A fourth illustrative embodiment of the wearable container assembly is seen generally at 400 in FIG. 20. Referring to this figure, it can be seen that, in most respects, the fourth illustrative embodiment is similar to that of the preceding embodiments. Moreover, many elements are common to all such embodiments. For the sake of brevity, the elements that the fourth illustrative embodiment of the wearable container assembly has in common with the first, second, and third embodiments will not be discussed because these components have already been explained in detail above. Furthermore, in the interest of clarity, these elements are denoted using the same reference characters that were used in the preceding embodiments.

In the fourth illustrative embodiment, as best shown in the image in the lower, left-hand corner of FIG. 20, the fastener member that is attached to the bottom surface 50*b* of the base portion 50 of the wearable container assembly 400 is the form of a headband 70, rather than the hair clip 40 of the first embodiment, the safety pin 60 of the second embodiment, and the hair scrunchie 64 of the third embodiment. The headband 70 is provided with an elastically deformable body portion that enables the opposed end portions of the headband 70 to be separated from one another, and the headband 70 to be securely attached to the head of a user in a removable manner. For example, as illustrated in the image in the upper, right-hand corner of FIG. 20, the headband 70 may be used to securely attach the wearable container assembly 400 to the head of a user 58 over the hair of the user.

In addition to the fastener members illustrated in conjunction with the four illustrative embodiments of the wearable container assembly described above, it is to be understood that other suitable fastener members may also be used to removably attach the wearable container assembly to hair of a user, a limb of a user, or an article of clothing worn by the user. For example, in addition to the hair clip 40, the safety pin 60, the hair scrunchie 64, and the headband 70, the fastener member of the wearable container assembly may also comprise a wristband, or a lanyard that is worn around the neck or wrist of a user.

Figure 21:
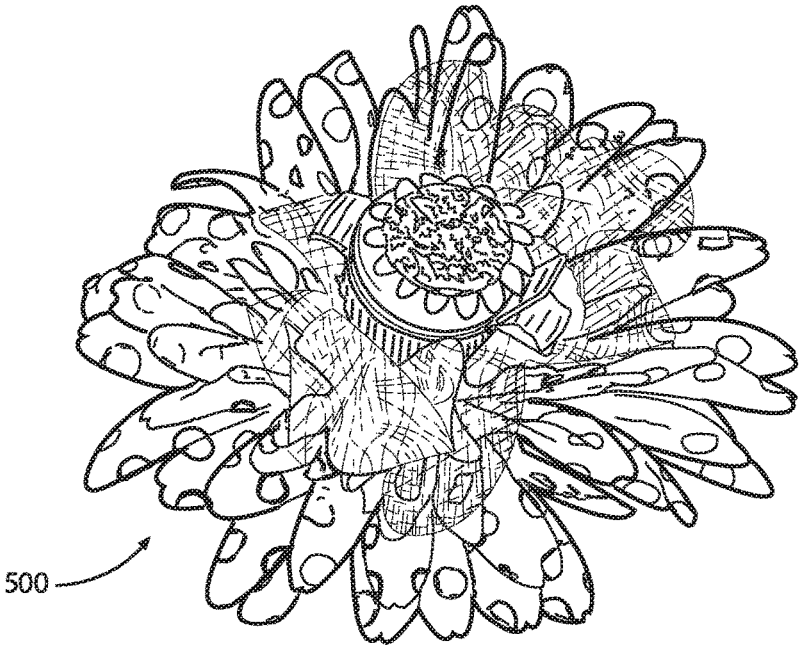
FIG. 21 is a top perspective view of a wearable container assembly for holding a topical substance, according to a fifth embodiment of the invention.
Figure 22:
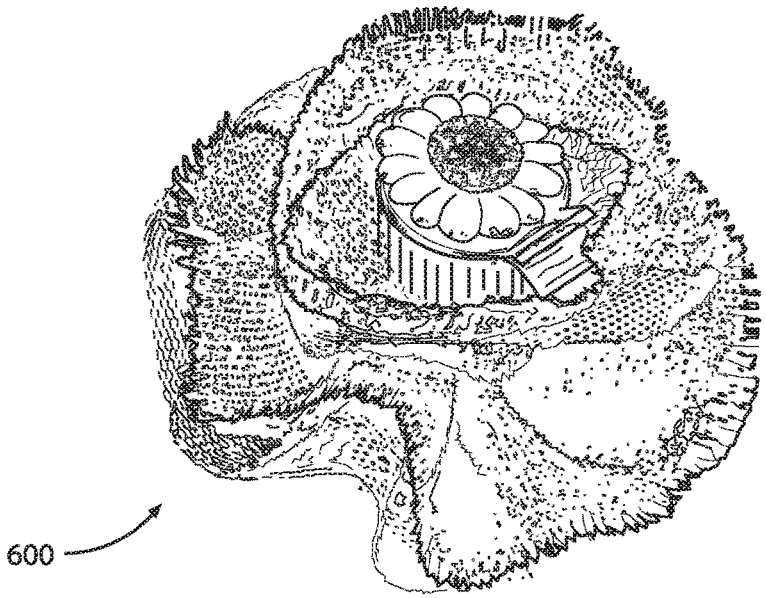
FIG. 22 is a top perspective view of a wearable container assembly for holding a topical substance, according to a sixth embodiment of the invention.
Figure 23:
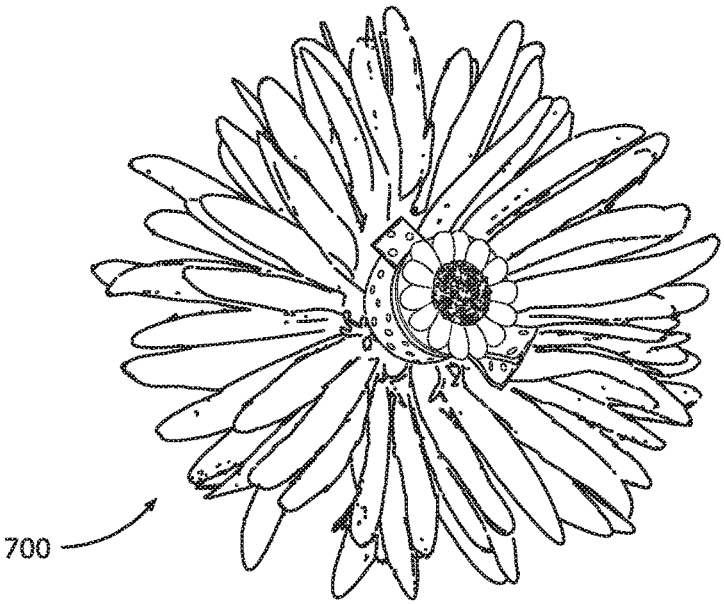
FIG. 23 is a top perspective view of a wearable container assembly for holding a topical substance, according to a seventh embodiment of the invention.
Figure 24:
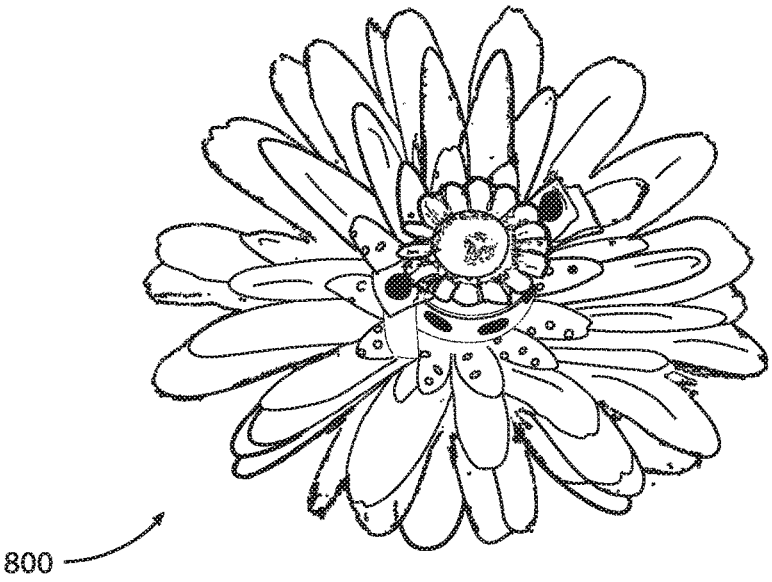
FIG. 24 is a top perspective view of a wearable container assembly for holding a topical substance, according to an eighth embodiment of the invention.
Figure 25:
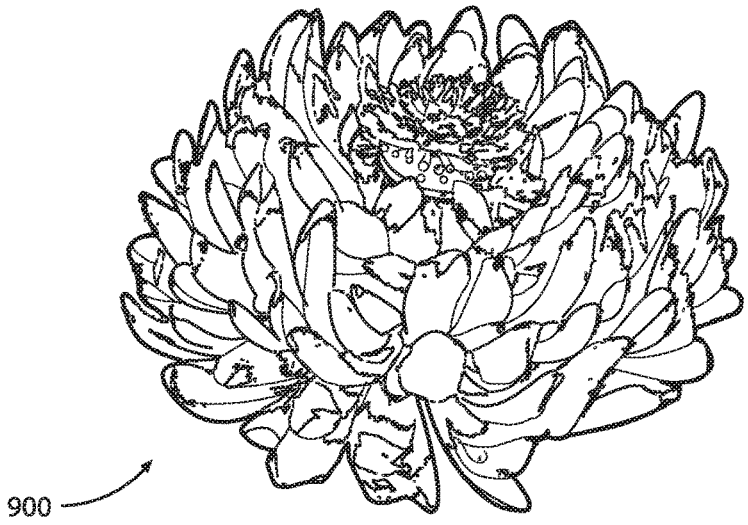
FIG. 25 is a top-side perspective view of a wearable container assembly for holding a topical substance, according to a ninth embodiment of the invention.
Figure 26:
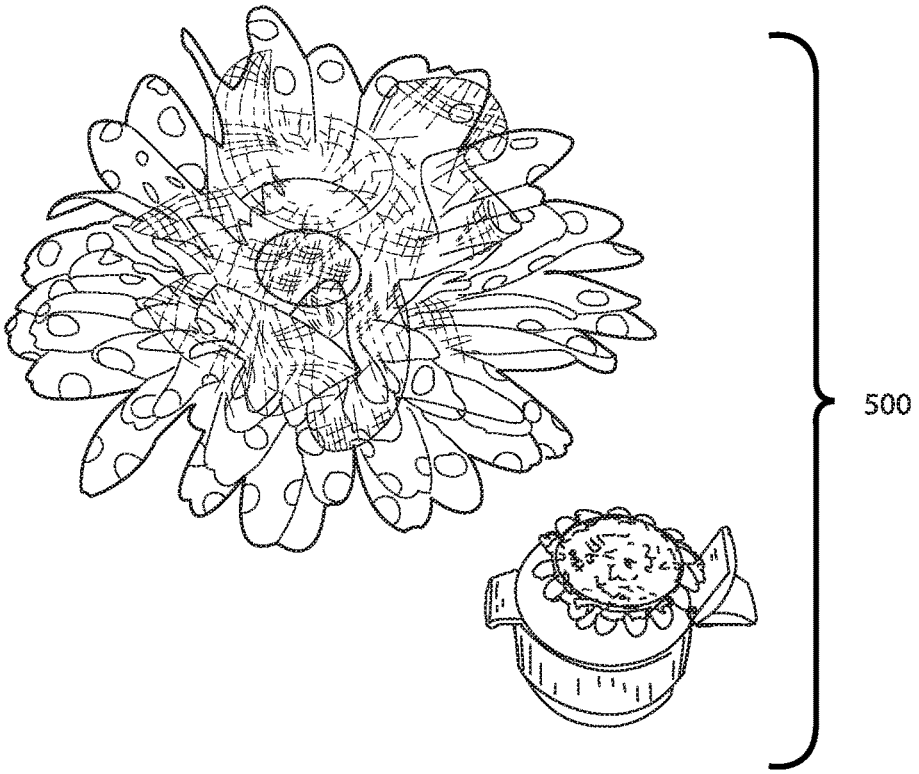
FIG. 26 is a partially exploded perspective view of the wearable container assembly of FIG. 21, wherein the container subassembly is shown separated from the remainder of the wearable container assembly.
Figure 27:
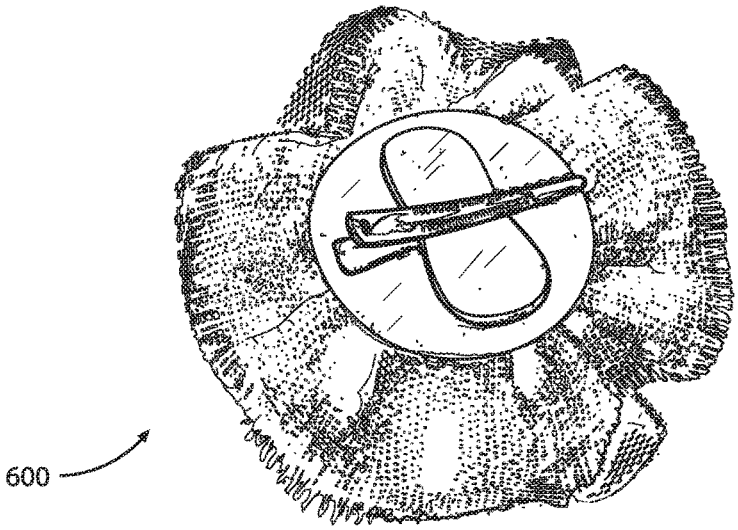
FIG. 27 is a bottom perspective view of the wearable container assembly of FIG. 22.
Figure 28:
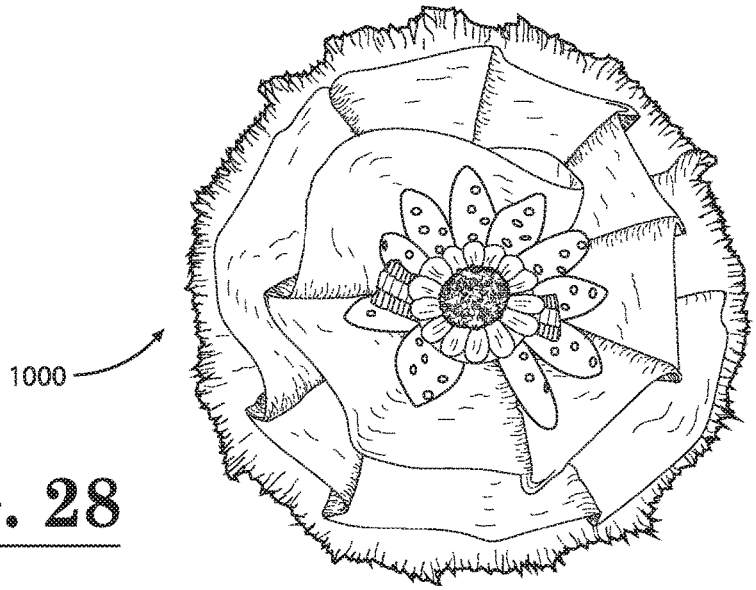
FIG. 28 is a top perspective view of a wearable container assembly for holding a topical substance, according to a tenth embodiment of the invention.

Additional illustrative embodiments of the wearable container assembly are depicted in FIGS. 21-28. These embodiments are similar to the embodiments described above, except that the decorative elements (e.g., the decorative flowers) are different from those described and illustrated above with regard to the first four embodiments. With reference to these figures, a fifth illustrative embodiment 500 is shown in FIGS. 21 and 26, a sixth illustrative embodiment 600 is shown in FIGS. 22 and 27, a seventh illustrative embodiment 700 is shown in FIG. 23, an eighth illustrative embodiment 800 is shown in FIG. 24, a ninth illustrative embodiment 900 is shown in FIG. 25, and a tenth illustrative embodiment 1000 is shown in FIG. 28.

It is readily apparent that the aforedescribed wearable container assembly 100, 200, 300, 400, 500, 600, 700, 800, 900, 1000 offers numerous advantages. First, the aforedescribed wearable container assembly 100, 200, 300, 400, 500, 600, 700, 800, 900, 1000 is capable of performing multiple functions, such as serving as both a hair clip and container for a topical substance (i.e., a hair clip having an integral topical substance dispenser). Secondly, the wearable container assembly 100, 200, 300, 400, 500, 600, 700, 800, 900, 1000 incorporates a removable container for a topical substance so that the topical substance can be easily dispensed by the user thereof without necessitating the removal of the wearable device from the body portion or the clothing of the user when it is desired to use the topical substance. Also, the removable nature of the container also enables the container to be easily refilled with the topical substance if desired, or for various containers to be interchangeably used with the same base portion 50 of the wearable container assembly. Finally, the wearable container assembly 100, 200, 300, 400, 500, 600, 700, 800, 900, 1000 described herein is capable of being securely attached to the user, or to an article of clothing worn by the user, so that the wearable device does not become inadvertently detached from the user or the user's clothing. Advantageously, the wearable container assembly 100, 200, 300, 400, 500, 600, 700, 800, 900, 1000 described herein obviates the need for separately carrying a topical substance (e.g., lip balm) on one's person (e.g., in a pocket) or in a hand bag, such as a purse, where it can become easily lost with all of the other items disposed therein.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A wearable container assembly for holding a topical substance configured to be applied to a portion of a body of a user, said wearable container assembly comprising:

a base portion having a top surface and a bottom surface, said base portion including one or more decorative elements attached to said top surface thereof;

a fastener member attached to said bottom surface of said base portion, said fastener member configured to removably attach said wearable container assembly to hair of a user, a limb of said user, or an article of clothing worn by said user; and a container subassembly for holding a topical substance that is configured to be applied to a portion of a body of said user, said container subassembly removably coupled to said base portion by attachment means, said container subassembly comprising a container body portion with a detachable lid attached to said container body portion, said detachable lid being removably attached to an upper rim portion of said container body portion by means of a snap-fit type engagement, said upper rim portion of said container body portion comprising a circumferential projection disposed on an outer surface thereof, and said detachable lid comprising an internal groove that corresponds to said circumferential projection on said upper rim portion of said container body portion.

2. The wearable container assembly according to claim 1, wherein said base portion is in the form of a generally planar member.

3. The wearable container assembly according to claim 1, wherein said base portion is generally circular in shape.

4. The wearable container assembly according to claim 1, wherein said one or more decorative elements comprise one or more artificial flowers or organic flowers.

5. The wearable container assembly according to claim 1, wherein said fastener member comprises one of: (i) a hair clip, (ii) a safety pin, (iii) a hairband, (iv) a wristband, (v) a hair scrunchie, and (vi) a lanyard.

6. The wearable container assembly according to claim 1, further comprising an attachment strip that attaches said fastener member to said bottom surface of said base portion.

7. The wearable container assembly according to claim 1, wherein said container subassembly is in the form of a cylindrical container with a central cavity for holding said topical substance.

8. The wearable container assembly according to claim 1, further comprising a hinge member that hingedly connects said detachable lid to said container body portion.

9. The wearable container assembly according to claim 8, further comprising a body tab portion extending radially outward from said container body portion, and a lid tab portion extending radially outward from said detachable lid, said lid tab portion configured to be grasped by said user so as to facilitate the removal of said detachable lid from said container body portion by said user.

10. The wearable container assembly according to claim 1, wherein said topical substance comprises one of: (i) lip balm that is configured to be applied to lips of said user, (ii) skin cream that is configured to be applied to skin of said user, and (iii) blush makeup that is configured to be applied to a face of said user.

11. The wearable container assembly according to claim 1, wherein said attachment means that removably couples said container subassembly to said base portion comprises one of: (i) a hook-and-loop fastener device; (ii) a friction-fit attachment device that includes a projection portion on one of said container subassembly and said base portion, and a recess on the other of said container subassembly and said base portion that is configured to matingly engage with said projection portion; and (iii) a magnetic attachment device that includes at least one magnet disposed on one of said container subassembly and said base portion, and a magnetic material disposed on the other of said container subassembly and said base portion that is magnetically engageable with said at least one magnet.

12. A wearable container assembly for holding a topical substance configured to be applied to a portion of a body of a user, said wearable container assembly comprising:

a base portion having a top surface and a bottom surface, said base portion including one or more decorative elements attached to said top surface thereof;

a fastener member attached to said bottom surface of said base portion, said fastener member configured to removably attach said wearable container assembly to hair of a user, a limb of said user, or an article of clothing worn by said user; and a container subassembly for holding a topical substance that is configured to be applied to a portion of a body of said user, said container subassembly removably coupled to said base portion by attachment means, said container subassembly comprising a container body portion with a detachable lid attached to said container body portion, wherein said detachable lid is removably attached to an upper rim portion of said container body portion by means of a threaded engagement, said upper rim portion of said container body portion comprising a plurality of external threads disposed on an outer surface thereof, and said detachable lid comprising a plurality of internal threads that correspond to said plurality of external threads on said upper rim portion of said container body portion.

13. A wearable topical substance container assembly configured to be worn by a user, said wearable topical substance container assembly comprising:

a base portion having a top surface and a bottom surface, said base portion including one or more decorative elements attached to said top surface thereof;

a fastener member attached to said bottom surface of said base portion, said fastener member configured to removably attach said wearable topical substance container assembly to hair of a user, a limb of said user, or an article of clothing worn by said user;

a container subassembly having a cavity portion, said container subassembly removably coupled to said base portion by attachment means, said container subassembly comprising a container body portion with a detachable lid attached to said container body portion;

a hinge member that hingedly connects said detachable lid to said container body portion, said hinge member comprising a first hinge portion connected to said container body portion and a second hinge portion connected to said detachable lid, said second hinge portion being rotatable relative to said first hinge portion such that said detachable lid is capable of being rotated upwardly away from said container body portion when said detachable lid is moved from a closed position to an open position by said user; and a topical substance disposed in said cavity portion of said container subassembly, said topical substance being configured to be applied to a portion of a body of said user.

14. The wearable topical substance container assembly according to claim 13, wherein said fastener member comprises one of: (i) a hair clip, (ii) a safety pin, (iii) a hairband, (iv) a wristband, (v) a hair scrunchie, and (vi) a lanyard.

15. The wearable topical substance container assembly according to claim 13, wherein said container subassembly is in the form of a cylindrical container, said cavity portion of said container subassembly being disposed centrally within said cylindrical container.

16. The wearable topical substance container assembly according to claim 13, wherein said topical substance comprises one of: (i) lip balm that is configured to be applied to lips of said user, (ii) skin cream that is configured to be applied to skin of said user, and (iii) blush makeup that is configured to be applied to a face of said user.

17. The wearable topical substance container assembly according to claim 13, wherein said second hinge portion of said hinge member is rotatable relative to said first hinge portion of said hinge member about a rotational axis disposed generally parallel to said base portion.

18. The wearable topical substance container assembly according to claim 17, wherein said first hinge portion of said hinge member extends radially outward from said container body portion, and said second hinge portion of said hinge member extends radially outward from said detachable lid.

19. The wearable topical substance container assembly according to claim 13, wherein said detachable lid is removably attached to an upper rim portion of said container body portion by means of a friction-fit type engagement.

20. The wearable topical substance container assembly according to claim 13, wherein said detachable lid is removably attached to an upper rim portion of said container body portion by means of a snap-fit type engagement, said upper rim portion of said container body portion comprising a circumferential projection disposed on an outer surface thereof, and said detachable lid comprising an internal groove that corresponds to said circumferential projection on said upper rim portion of said container body portion.

* * * * *